US011224262B2

(12) United States Patent
Yamada

(10) Patent No.: US 11,224,262 B2
(45) Date of Patent: Jan. 18, 2022

(54) INNER BOOTS

(71) Applicant: HOOD INC., Gujo (JP)

(72) Inventor: Yukihiko Yamada, Gujo (JP)

(73) Assignee: HOOD INC., Gujo (JP)

( * ) Notice: Subject to any disclaimer, the term of this patent is extended or adjusted under 35 U.S.C. 154(b) by 537 days.

(21) Appl. No.: 15/320,423

(22) PCT Filed: Aug. 24, 2015

(86) PCT No.: PCT/JP2015/073656
§ 371 (c)(1),
(2) Date: Dec. 20, 2016

(87) PCT Pub. No.: WO2016/031747
PCT Pub. Date: Mar. 3, 2016

(65) Prior Publication Data

US 2017/0181494 A1 Jun. 29, 2017

(30) Foreign Application Priority Data

Aug. 30, 2014 (JP) ..... JP2014-176690
Dec. 26, 2014 (JP) ..... JP2014-266410

(51) Int. Cl.
*A43B 5/04* (2006.01)
*A43B 23/07* (2006.01)
(Continued)

(52) U.S. Cl.
CPC ..... *A43B 5/0405* (2013.01); *A43B 1/14* (2013.01); *A43B 5/0486* (2013.01); *A43B 5/1616* (2013.01); *A43B 23/07* (2013.01)

(58) Field of Classification Search
CPC ..... A43B 5/0405; A43B 5/1616; A43B 19/00; A43B 23/07
See application file for complete search history.

(56) References Cited

U.S. PATENT DOCUMENTS 4,723,364 A * 2/1988 Marxer ..... A43B 5/0405 36/10
5,067,257 A * 11/1991 Coomer ..... A43B 5/0405 36/117.6
(Continued)

FOREIGN PATENT DOCUMENTS

EP 0351396 A2 * 1/1990 ..... A43B 3/0047
FR 2541095 A1 * 8/1984 ..... A43B 5/0405
(Continued)

OTHER PUBLICATIONS https://www.sciencedirect.com/topics/chemistry/vinyl-acetate; Roy J. Crawford, James L. Throne, Rotational Molding Technology, 2002, Chapter 2.3.5 (Year: 2002).*
(Continued)

*Primary Examiner* — Megan E Lynch
(74) *Attorney, Agent, or Firm* — Muncy, Geissler, Olds & Lowe, P.C.

(57) ABSTRACT

To provide a sports inner boot that ensures removal from a sports outer boot to allow an inside to be easily washed and where a drying time be a comparatively short time. A sports inner boot made of a thermoplastic plastic includes a bottom plate disposed in the sports outer boot and a foot wrap portion formed at the bottom plate. The bottom plate and the foot wrap portion are integrally formed. The bottom plate and the foot wrap portion contain an ethylene vinyl acetate copolymer material (EVA).

9 Claims, 6 Drawing Sheets

(51) Int. Cl.
*A43B 1/14* (2006.01)
*A43B 5/16* (2006.01)

(56) References Cited

U.S. PATENT DOCUMENTS

| | | | | | |
|---|---|---|---|---|---|
| 5,211,672 | A * | 5/1993 | Andujar | A43B 5/00 | 36/106 |
| 5,647,149 | A * | 7/1997 | Dalebout | A43B 5/0405 | 36/10 |
| 5,673,448 | A * | 10/1997 | Lang | A43B 5/0405 | 12/142 P |
| 5,893,222 | A * | 4/1999 | Donnelly | A43B 5/0405 | 36/10 |
| 5,937,542 | A * | 8/1999 | Bourdeau | A43B 5/0405 | 36/10 |
| 5,942,172 | A * | 8/1999 | Huang Liu | A43B 7/28 | 264/257 |
| 6,025,414 | A * | 2/2000 | Rich | A43B 5/0405 | 523/167 |
| 6,604,477 | B1 * | 8/2003 | Hozan | A43B 7/12 | 112/475.16 |
| 2003/0097768 | A1 * | 5/2003 | Baek | A43B 5/0405 | 36/55 |
| 2004/0244221 | A1 * | 12/2004 | Hall | A43B 5/0405 | 36/10 |
| 2005/0241189 | A1 * | 11/2005 | Elkington | A43B 3/0047 | 36/117.6 |
| 2008/0131648 | A1 * | 6/2008 | Baychar | B32B 3/26 | 428/90 |
| 2009/0000152 | A1 * | 1/2009 | Agnew | A43B 5/0405 | 36/118.1 |
| 2009/0307930 | A1 * | 12/2009 | Perizzolo | A43B 5/0405 | 36/115 |
| 2012/0144700 | A1 * | 6/2012 | Zhao | A43B 5/0401 | 36/99 |
| 2013/0192086 | A1 * | 8/2013 | Tawney | A43B 9/00 | 36/12 |
| 2014/0066530 | A1 * | 3/2014 | Shen | C08K 3/013 | 521/40.5 |
| 2015/0230541 | A1 * | 8/2015 | Bacino | A43B 7/125 | 36/44 |

FOREIGN PATENT DOCUMENTS

| | | | | |
|---|---|---|---|---|
| FR | 2971918 | A1 * | 8/2012 | A43B 5/0405 |
| JP | H8-506494 | A | 7/1996 | |
| JP | H8-224102 | A | 9/1996 | |
| JP | H11-276201 | A | 10/1999 | |
| JP | 2000-152802 | A | 6/2000 | |
| JP | 2001-46106 | A | 2/2001 | |
| JP | 2001-218604 | A | 8/2001 | |
| KR | 2000-0006616 | A | 2/2000 | |

OTHER PUBLICATIONS

The Notice of Allowance for the corresponding KR application No. 10-2016-7035681 dated Nov. 2, 2020.

* cited by examiner

INNER BOOTS

TECHNICAL FIELD

The present invention relates to inner boots that can be removably inserted into outer boots.

BACKGROUND ART

Generally, there has been provided sports boots that use inner boots. The sports boots include, for example, snowboard boots and ski boots. These snowboard boots and ski boots use sports inner boots fitting inside outer boots between the outer boots and feet of a user for booting. The sports inner boots are removable from the outer boots or are secured to the outer boots.

The conventional snowboard boots are, for example, constituted of boots-type inner boots and outer boots. As disclosed in Patent Document 1, inner and outer materials of the conventional snowboard inner boots are laminated with cloth. The inside is inserted into the cloth-coated outer boots. A cushion is disposed in a range from above a heel part up to above an ankle level between the inner boot and the outer boot, that is, in a range of a bottom portion of a trunk part (for example, Patent Document 1 (see paragraph 0018)).

Patent Document 1: Japanese Unexamined Patent Application Publication No. 2000-152802

DISCLOSURE OF THE INVENTION

Problems to be Solved by the Invention

However, with the conventional snowboard or ski inner boots, after snowboarding or skiing, the inside of the inner boots exhibits extremely high humidity. Therefore, it is necessarily for a snowboarder or a skier himself/herself or a rental shop to take out the inner boots for drying.

Moreover, as for the drying, drying the clothes and the cushions of the inner boots requires a considerable time, making the work troublesome. That is, with the conventional snowboard or ski inner boots, refusing the troublesome work, the inside of the inner boots was not able to be easily washed.

Athlete's foot bacteria or trichophyton propagates at the inside of the conventional snowboard or ski inner boots; therefore, when the snowboard or ski inner boots are rented to another snowboarder or skier, the snowboarder or the skier is possibly affected by mycosis.

Thus, the conventional snowboard or ski inner boots have problems in terms of hygiene in the usage of the snowboard or ski inner boots. The other sports inner boots also have similar problems.

An object of the present invention is to provide inner boots that can be removed from outer boots to easily wash the inside and whose drying time can be a comparatively short time.

SUMMARY OF THE INVENTION

An inner boot according to the present invention is made of a thermoplastic plastic removably inserted into an outer boot. The inner boot includes a bottom plate and a foot wrap portion. The bottom plate is disposed in the outer boot. The foot wrap portion is formed at the bottom plate. The bottom plate and the foot wrap portion are integrally formed. A material of the thermoplastic plastic contains an ethylene vinyl acetate copolymer material (EVA).

The inner boots of the present invention include, for example, sports inner boots and work inner boots. The sports inner boots include snowboard inner boots, ski inner boots, alpine skiing inner boots, skate inner boots, ice hockey inner boots, and other winter sports inner boots, roller skate inner boots, in-line skate inner boots, mountaineering inner boots, bike inner boots, golf inner boots, and other outdoor sports inner boots. The work inner boots include inner boots for arctic boots, inner boots for long boots, and other work inner boots. The inner boots of the present invention are preferably used for applications of snowboard, ski, skate, roller skate, in-line skate, and ice-skate and more preferably appropriate for an application of the snowboard, the ski, or a water jump of these sports. The inner boots of the present invention can also be used for an application as inner boots for work shoes and are also appropriate for an application of renting these boots.

An ethylene vinyl acetate copolymer is excellent in form adaptability to be molded into any given shape, and with the ethylene vinyl acetate copolymer, a thickness can be changed part by part. This part-by-part change in thickness is referred to as a so-called uneven thickness structure. For example, the inner boots with the uneven thickness structure in which the thickness of the inside is changed so as to go along the shape of the feet of the user without a change in the outside of the outer boots can be configured. Although the inner boots with this uneven thickness structure can fixedly fit the feet of the user and are less likely to absorb an impact at thin thickness parts, the inner boots are likely to absorb the impact at thick thickness parts.

Hardness of the inner boots is 25 to 55°, preferably 30° or more and less than 45°, and more preferably 33 to 43°. Performing an injection molding with the hardness of less than 30° possibly generates so-called sink marks in the inner boots. The excess of the hardness of 45° possibly causes a problem in a so-called entry of feet. The sink marks mean that a mold is not filled with an EVA resin and therefore the inner boots cannot be molded into an accurate product shape. The problem in the entry of feet means that there may be a case that the user feels hardness, a poor contact of the inner boots with the feet, and a pain when the user wears the inner boots.

When these inner boots are used for sports application such as the snowboard or the ski, since the inner boots provide waterproof performance and good feel of entry of the feet, this ensures fixedly holding the feet. In view of this, the inner boots are especially appropriate for the sports application that requires a balance equilibrium sense to put a force, agility for instant move, and a cushioning property. Since having the comparatively flexible hardness, 30° or more and less than 45°, and the uneven thickness structure, the inner boots are excellent in the impact resistance alone without the use of a cushion material. Additionally, since being flexible, the inner boots give the good feel of entry of the feet such as a touch. Since the use of the inner boots for the application to the inner boots for work shoes ensures fixedly holding the feet, the inner boots are excellent in heat retention and work efficiency. To further improve the feel of entry of the feet, a surface treatment that forms, for example, crimps and unpenetrated unevenness may be performed on the surfaces of the inner boots.

The content percentage of the vinyl acetate in the inner boot is 10 to 45%, preferably 15% or more and less than 45%, and further preferably 25 to 43%.

In the inner boot, the thermoplastic plastic preferably contains a plurality of ethylene vinyl acetate copolymers with vinyl acetates of different content percentages as the material.

The inner boot may include an expandable front opening and a front open/close body. The expandable front opening forms an upper portion of the foot wrap portion into an approximately tubular shape. A front portion of the front opening forms a cutout from a rim to an instep portion. The front open/close body is integrally formed with the foot wrap portion to ensure closing the front opening.

The inner boot may include an expandable rear opening and a rear open/close body. The expandable rear opening forms an upper portion of the foot wrap portion into an approximately tubular shape. A rear portion of the rear opening forms a cutout from a rim to a heel portion. The rear open/close body is integrally formed with the foot wrap portion to ensure closing the rear opening.

The inner boot may include an expandable lateral opening and a lateral open/close body. The expandable lateral opening forms an upper portion of the foot wrap portion into an approximately tubular shape. A lateral portion of the lateral opening forms a cutout from a rim to one malleolus portion. The lateral open/close body is integrally formed with the foot wrap portion to ensure closing the lateral opening.

Effects of the Invention

The inner boot according to claim 1 of the present invention is an inner boot made of a thermoplastic plastic removably inserted into an outer boot. The inner boot includes a bottom plate and a foot wrap portion. The bottom plate is disposed in the outer boot. The foot wrap portion is formed at the bottom plate. The bottom plate and the foot wrap portion are integrally formed. A material of the thermoplastic plastic contains an ethylene vinyl acetate copolymer material (EVA). Accordingly, the inner boot has a property of stability against water and provides effects where the inner boot can be removed from the outer boot to easily wash the inside and the drying time can be a comparatively short time.

With the inner boot according to claim 2 of the present invention, in addition to the effects provided by the inner boot according to claim 1, a content percentage of a vinyl acetate is 10 to 45%. This lowers a crystalline compared with the vinyl acetate with low content percentage and increases the flexibility. This provides effects of ensuring having sufficient stretch and flexibility to support the foot of the user.

With the inner boot according to claim 3 of the present invention, in addition to the effects provided by the inner boot according to claim 1 or 2, high flexibility can be developed even under a low temperature, thereby ensuring a good wear comfort.

With the inner boot according to claim 4 of the present invention, in addition to the effects provided by the inner boot according to any one of claims 1 to 3, the inner boot includes an expandable front opening and a front open/close body. The expandable front opening forms an upper portion of the foot wrap portion into an approximately tubular shape. A front portion of the front opening forms a cutout from a rim to an instep portion. The front open/close body is integrally formed with the foot wrap portion to ensure closing the front opening. This provides an effect that opening the front open/close body and inserting the foot allows the user to easily wear and remove the inner boot.

With the inner boot according to claim 5 of the present invention, in addition to the effects provided by the inner boot according to any one of claims 1 to 3, the inner boot includes an expandable rear opening and a rear open/close body. The expandable rear opening forms an upper portion of the foot wrap portion into an approximately tubular shape. A rear portion of the rear opening forms a cutout from a rim to a heel portion. The rear open/close body is integrally formed with the foot wrap portion to ensure closing the rear opening. This provides an effect that opening the rear open/close body and inserting the foot allows the user to easily wear and remove the inner boot.

With the inner boot according to claim 6 of the present invention, in addition to the effects provided by the inner boot according to any one of claims 1 to 3, the inner boot includes an expandable lateral opening and a lateral open/close body. The expandable lateral opening forms an upper portion of the foot wrap portion into an approximately tubular shape. A lateral portion of the lateral opening forms a cutout from a rim to one malleolus portion. The lateral open/close body is integrally formed with the foot wrap portion to ensure closing the lateral opening. This provides an effect that opening the lateral open/close body and inserting the foot allows the user to easily wear and remove the inner boot.

DESCRIPTION OF PREFERRED EMBODIMENTS

First Embodiment

Figure 1:
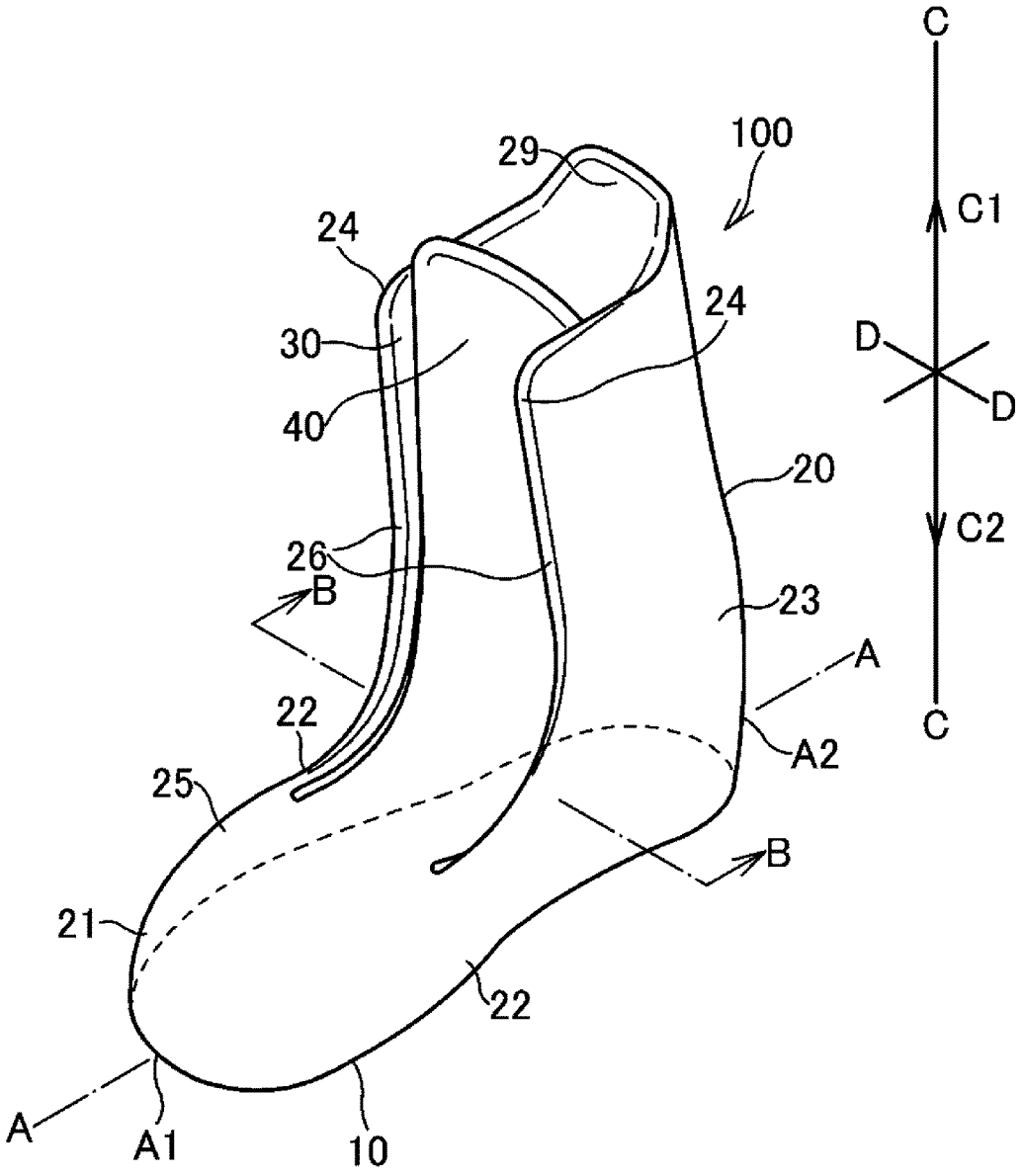
FIG. 1 is a perspective view illustrating sports inner boots of an embodiment.

The following describes forms to embody the present invention with reference to the drawings. Sports inner boots 100 of this embodiment are one example of an application to snowboard or ski inner boots. FIG. 1 is a perspective view illustrating the sports inner boots 100 of the embodiment applied for snowboard or ski. A front portion means an A1 side in the line A-A and a rear portion means an A2 side in the line A-A illustrated in FIG. 1. An upper portion means a C1 side in the line C-C and a lower portion means a C2 side in the line C-C illustrated in FIG. 1. A lateral portion or a lateral direction means a direction in the line D-D.

As illustrated in FIG. 1, the sports inner boots 100 of this embodiment includes a bottom plate 10, a foot wrap portion 20, a front opening 30, and a front open/close body 40. The sports inner boots 100 are made of a thermoplastic plastic and formed into an approximately tubular shape in a cross section and an approximately L shape in a vertical cross section. The sports inner boots 100 are removably inserted into snowboard or ski outer boots for use. Product hardness of the sports inner boots 100 is 25 to 55°.

The bottom plates 10 are inserted into the snowboard or ski outer boots and disposed between soles of the user and the outer boots for use. The bottom plate 10 includes a tread portion, an arch portion, and a heel portion. The arch portion, which corresponds to a plantar arch of the user, employs an uneven thickness structure formed to be thicker than the other tread portion and heel portion.

The foot wrap portions 20 are sites that wrap the feet of the user. The foot wrap portion 20 is a part corresponding to a site referred to as an instep portion or an upper portion, which are terms generally used for shoes. The foot wrap portion 20 is formed integrally with the bottom plate 10. The foot wrap portion 20 includes a top surface portion 21, lateral surface portions 22, and a tubular portion 23.

The top surface portion 21 is a part that covers a toe of the foot of the user. The top surface portion 21 is formed so as to draw an arc having a single point A1, which corresponds to a second finger of a toe of the user, as a peak. The top surface portion 21 has a laterally asymmetric shape with the single point A1 as the peak with respect to the line A-A, which is a center line passing from A1 to a center A2 of a heel portion 27 illustrated in FIG. 1.

The lateral surface portions 22 are parts that cover the foot of the user from lateral sides to a rear side and are disposed at both sides of the sports inner boot 100. Both lateral surface portions 22 and 22 are installed consecutively to the top surface portion 21, integrated at the rear center of the sports inner boot 100, and are installed consecutively to the tubular portion 23.

The tubular portion 23 is a part that coats the instep and a shin of the user. The tubular portion 23 forms an upper portion of the foot wrap portion 20 into an approximately tubular shape and includes the front opening 30.

The front opening 30 is an expandable part of the foot wrap portion 20 that forms both cutouts 26 and 26 from rims 24 to an instep portion 25 on a front portion of the tubular portion 23. The rear portion of the tubular portion 23 is formed to further warp an upper end of a calf portion 29, which is a site up to a calf of the user, to the rear portion side so as to go along the calf of the user.

The front open/close body 40 is disposed between both cutouts 26 and 26. To ensure closing the front opening 30, a front portion of the front open/close body 40 is integrally formed with the top surface portion 21 of the foot wrap portion 20. The front open/close body 40 is disposed inside the front opening 30 of the tubular portion 23. For use, the front open/close body 40 is opened forward with a front portion of the front open/close body 40 as an axis, and the front opening 30 is expanded as necessary, thus ensuring putting the foot of the user from the tubular portion 23 to the inside of the sports inner boot 100.

As a material of the sports inner boots 100, an ethylene vinyl acetate copolymer resin containing an ethylene and a vinyl acetate (VA) is used. The ethylene vinyl acetate copolymer can be produced by performing a radical copolymerization on the ethylene and the vinyl acetate at high temperature and high pressure. The ethylene vinyl acetate copolymer is a foamed plastic from which closed cell foams are obtained because of its property and that can be mixed with many materials. This foamed plastic is a thermoplastic plastic excellent in flexibility and rubber elasticity and abounding in low temperature property.

First, feet molds with some kinds of feet sizes for typical person are prepared. Next, performing a foam molding with a material and the feet molds manufactures the sports inner boots 100 according to the embodiment. These feet molds correspond to the so-called uneven thickness structure and are formed such that the sports inner boots 100 as a molded product have the uneven thickness structure. As the material used for the molding, the ethylene vinyl acetate copolymer resin with a content grade of low to middle VA is appropriate. These sports inner boots 100 contain the ethylene vinyl acetate copolymer resin that has a surface hardness of 25 to 55°, a Melt Flow Rate (MFR) value of 7.0 g/10 min to 52.0 g/10 min, a content proportion of the vinyl acetate of 10% to 45%, EVA of 99.95%, and an additive of 0.05%.

The surface hardness of the ethylene vinyl acetate copolymer resin constituting these sports inner boots 100 and the product hardness of the sports inner boots 100 are SRIS0101 (spring type, Asker C type) measured in accordance with JIS S 6050. Units of the percentages (%) for the content proportion of the vinyl acetate, the combination percentages of the components of the material, and other percentages are weight % of a solid content.

Figure 2:
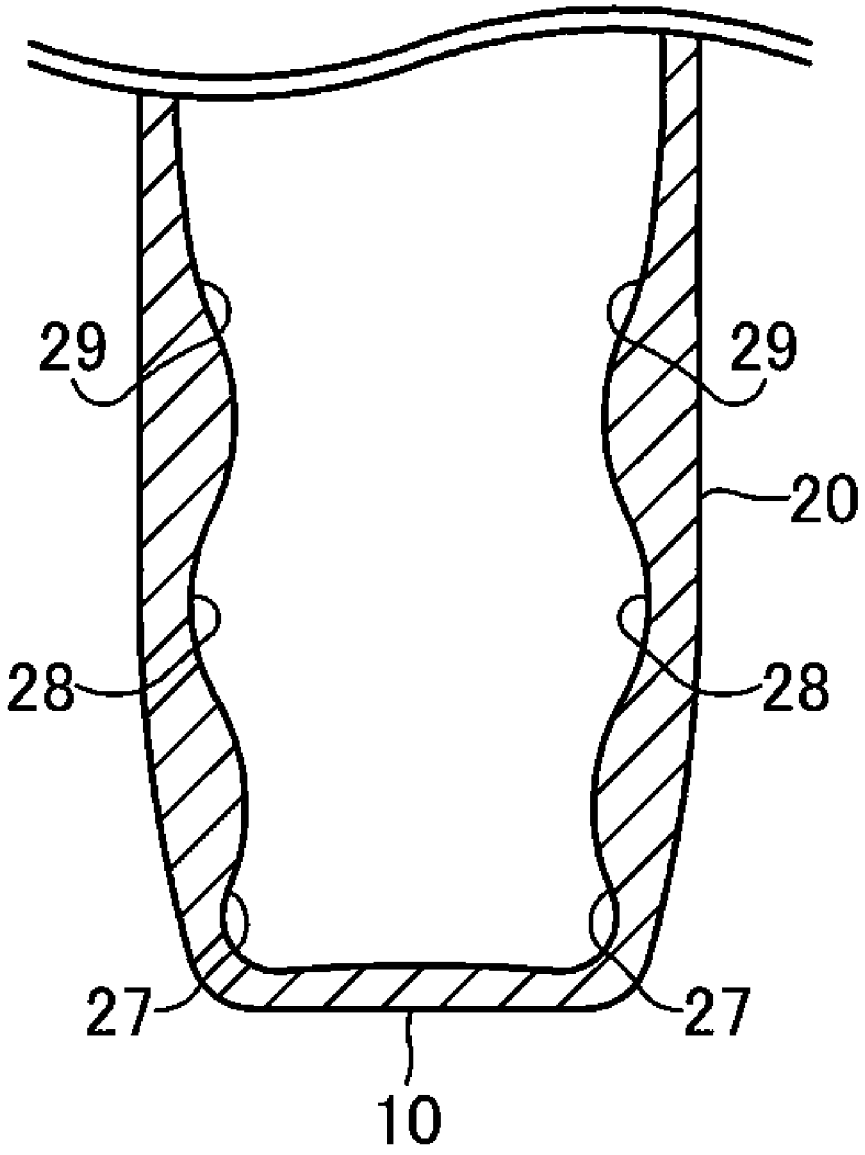
FIG. 2 is a partial cross-sectional view taken along the line B-B in FIG. 1.

FIG. 2 is a partial cross-sectional view taken along the line B-B in FIG. 1. As illustrated in FIG. 2, the sports inner boots 100 are integrally molded inner boots made of a single material where inner and outer materials are neither laminated nor coated with cloth or a similar material. The sports inner boots 100 are integrally molded inner boots with the uneven thickness structure made of the single material where another member such as a cushion is not disposed.

As illustrated in FIG. 2, the uneven thickness structure of the sports inner boots 100 is employed for the heel portion 27, which is formed so as to wrap the heel of the user, a malleolus portion 28, which is a part corresponding to a malleolus so as to wrap the malleolus of the user, and the calf portion 29, which extends from an upper side of the malleolus portion 28 so as to go along the calf of the user. That is, this uneven thickness structure employs a structure to fit the foot of the user in a range from the heel portion 27 to the calf portion 29 via above a level of the ankle, in addition to the arch portion on the bottom plate 10, that is, in a range of the entire foot of the user. More specifically, first, the rear portion of the heel portion 27 is formed into an approximately L shape, and the upper portion of the heel portion 27 is formed to be gradually thick so as to protect an Achilles tendon of the user. While the center of the malleolus portion 28 is thinned, the heel portion 27 is formed to be gradually thick as approaching peripheral edges. Furthermore, the calf portion 29 is formed to be gradually thin so as to go along the shape of the calf of the user As the material of the sports inner boots 100, the ethylene vinyl acetate copolymer (EVA), polyolefin, polyolefin elastomer, a thermoplastic resin elastomer, and a mixture of these materials are preferable. As the combination percentages of the components of the material of the sports inner boots 100, content percentages of one ethylene vinyl acetate copolymer (EVA) of 0 to 28% and another EVA of 13 to 4%, a content percentage of the polyolefin of 36 to 49%, and a content percentage of the thermoplastic resin elastomer of 6 to 16% are preferable. Adjusting the hardness of 30° or more and less than 45° is preferable.

The use of these materials improves fluidity during the molding and an impact resistance under low temperature and can manufacture the fully water-proofed, integrally molded sports inner boots 100 having a function as a thickness member with a certain amount of elasticity. As a method for manufacturing the sports inner boots 100, the foam molding can be easily performed. A method of the foam molding method includes, for example, a press foaming or an injection foaming.

In the material of the sports inner boots 100, as a foaming agent, for example, an azodicarbonamide and a dinitrosopentamethylenetetramine can be used. As a crosslinking agent, an organic peroxide such as a dicumyl peroxide can be used. Besides, a pigment, a lubricant, and a deodorant may be contained. Containing the deodorant can add an odor to the sports inner boots 100; therefore, a deodorant action is provided.

Figure 3:
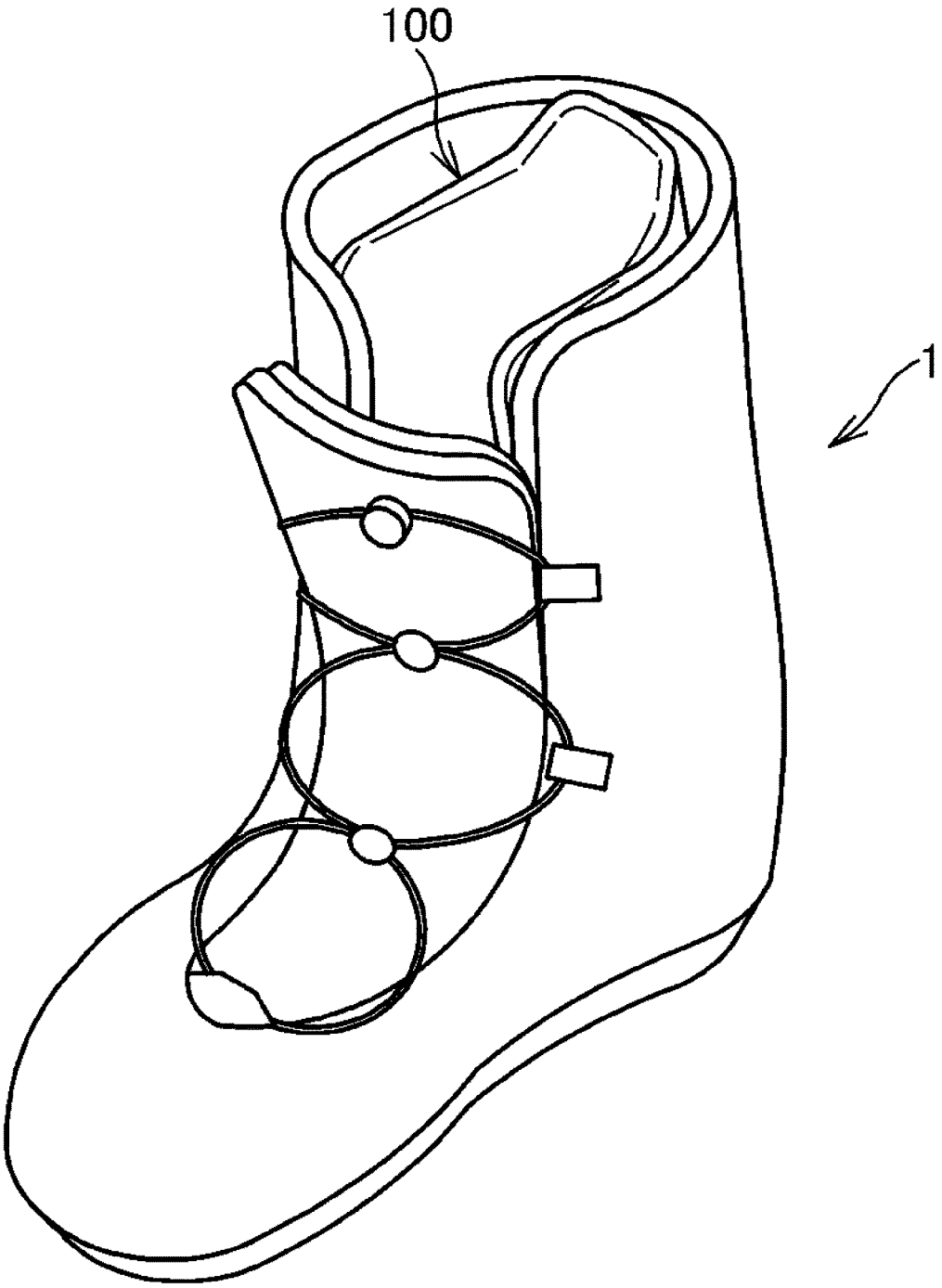
FIG. 3 is a perspective view illustrating a use state of the sports inner boots.

The following describes a method of using the sports inner boots 100 with reference to FIG. 3. FIG. 3 is a perspective view illustrating a use state of the sports inner boots 100. First, the sports inner boots 100 are inserted into sports outer boots 1 for disposition. When the user snowboards or skis, while these sports inner boots 100 are inserted into the sports outer boots 1, the user puts the feet into the sports outer boots 1.

An application of silicon-based spray for slipperiness to the sports inner boots 100 further smoothly puts the feet of the user to the inside like wearing long boots. As the silicon spray for slipperiness, for example, silicon-based spray (product number: E-1420-98 A) manufactured by KURE Engineering Ltd. can be used. Besides, food silicon-based spray may be used.

After the snowboarding or the skiing, the snowboarder or the skier can take out the sports inner boots 100 from the snowboard or ski outer boots 1. The removed sports inner boots 100 can be dried and washed.

With the sports inner boots 100 according to the embodiment, since the material of the bottom plate 10 and the foot wrap portion 20 contains the ethylene vinyl acetate copolymer (EVA), the sports inner boots 100 are stable against water and ultraviolet rays and the inside can be easily washed. Since the sports inner boots 100 are not soaked with water even washed, the drying time can be a comparatively short time. This allows the sports inner boots 100 to be easily cleaned.

Moreover, compared with the case where another material of the thermoplastic plastic is used, for example, compared with the case of using an urethane foam as the material, the production cost including a cost of equipment can be reduced. Thus, the sports inner boots 100 is excellent in moldability and excellent in weather resistance and stress crack resistance. This allows providing the sports inner boots 100 at a comparatively low-price and with good quality.

With the sports inner boots 100 whose content percentage of the one ethylene vinyl acetate copolymer (EVA) of 0 to 28%, another EVA of 13 to 4%, the product hardness of the ethylene vinyl acetate copolymer material (EVA) of 30° or more and less than 45°, the sports inner boots 100 feature repellence and ensures preventing the problem in the so-called entry of feet. When the user wears the inner boots, the case where the user feels the hardness, the poor contact of the inner boots with the feet, and the pain becomes rare; therefore, the inner boots provides the good feel of the entry of the feet.

Especially, since the content percentage of the vinyl acetate is 10 to 45%, this lowers a crystalline compared with the vinyl acetate with low content percentage and increases the flexibility, thereby ensuring having sufficient stretch and flexibility to support the feet of the user.

The sports inner boots 100 according to the embodiment are the integrally molded inner boots made of the single material where the inner and outer materials are neither laminated nor coated with the cloth or a similar material. Accordingly, the sports inner boots 100 feature the waterproof performance. This ensures the drying by the surface drying, ensuring shortening the drying time.

The sports inner boots 100 have the uneven thickness structure. This eliminates the need for partially disposing another member such as the cushion between the sports inner boots 100 and the outer boots. This allows shortening the drying time taken for the cushion or a similar member and allows the reduction in production cost. Furthermore, the sports inner boots 100 are the integrally molded inner boots made of the single material where the cushion or a similar member is not disposed, thereby ensuring fitting the shapes of the feet of the user at the low cost without the use of another member such as the cushion.

Since the bottom plate 10 is integrally molded with the foot wrap portion 20, the bottom plate 10 can double as an insole. Furthermore, since the arch portion of the bottom plate 10 is formed thicker than the other tread portion and heel portion, this allows preventing an open foot without disturbing a so-called lateral arch of the foot of the user. Additionally, the user easily applies his/her weight equally at good balance on the snowboard or the ski.

A crimp treatment may be performed on the surfaces of the sports inner boots 100 according to the embodiment. A large number of unpenetrated concave portions may be arranged and disposed on the entire or a part of top surfaces of the bottom plates 10 inside the sports inner boots 100. Since the concave portions do not absorb sweat and form an air layer with high heat retention, this features good heat retention. Since the sports inner boots 100 can be washed again and again for use, this gives a comfortable feeling even during sweating and good wear comfort.

[Molding Raw Material Change Test]

When the above-described sports inner boots of the first embodiment were molded, the material was variously changed to examine the formability, the hardness of the molded sports inner boots, and the wear comfort. Evaluation methods for these hardness and wear comfort are as follows.

<Formability>

An organoleptic evaluation was visually performed on the formability when the sports inner boots were molded by respective working examples by the following three grades.

Good: A break or a similar failure is not observed in the outer shape, and the sports inner boots can be molded into a desired shape.

Fair: A slight failure of a foam and the break of the mold are recognized.

Poor: The failure of the foam and the break of the mold are recognized.

<Hardness>

The sports inner boots obtained in the respective working examples were left for five hours under an atmosphere with a temperature of −20° C. After that, the hardness of the sports inner boots was measured by a rubber/plastic hardness meter (dual meter manufactured by TECLOCK Corporation) by a method compliant to SRIS0101 measured in accordance with JIS S 6050.

<Wear Comfort>

A touch when the sports inner boots obtained in the respective working examples were worn after being left for five hours under the atmosphere with the temperature of −20° C. was organoleptically evaluated by the following three grades.

Good: The sports inner boots exhibit appropriate flexibility and excellent fit.

Fair: Although the slight flexibility is recognized, the sports inner boots have insufficient fit.

Poor: No flexibility was recognized at all.

The raw material resins used in the molding raw material change test were as follows.

Resin A: EVA-1 (ethylene: 74%, vinyl acetate: 26%, MFR value=7.0 g/10 min.)

ResinB: EVA-2 (ethylene 60%, vinyl acetate 40%, MFR value=52.0 g/10 min.)

ResinC: polyolefin (POLYOLEFIN)

Resin D: polyolefin elastomer (POLYOLEFIN, ELASTOMER)

Resin E: thermoplastic resin elastomer-1 (ELSTOMER THERMOPLASTIC ELASTOMER)

ResinF: thermoplastic resin elastomer-2 (THERMOPLASTIC ELASTOMER)

The resin E is a material used for flexibleness. Meanwhile, the resin F has a property to slightly improve the elasticity of the product. To the above-described raw material resins, a zinc oxide (ZINC OXIDE), a zinc stearate (ZINC STEARATE), a crosslinking agent (BIS<TERT-BATYLPEROXYISOPROPYL>BENZINE), a foaming agent (AZOBISFORMAMIDE AZODICARBAMIDE), an accelerator-I (PROMOTER), an accelerator-2 (RAPID AGENT), fine talc powder (TALCPOWDER), a wear resistant agent (WEAR RESISTANT AGENT), a stearic acid (STEARIC ACID), and a titanium dioxide (TITANIUM DIOXIDE) are preliminarily added (Table 1 shows proportions of these additives in the formed product).

WORKING EXAMPLE 1

The above-described respective synthetic resins were mixed so as to meet the proportions in the following Table 1. The injection molding was performed on the mixed resin at a predetermined temperature by a usual method to obtain the sports inner boots of Working Example 1. A cylinder temperature (a temperature at which the EVA resin is melted) of a molding machine is 80 to 100 degrees (° C.), and a mold temperature is 175 to 185 degrees (° C.). The hardness and the wear comfort of the obtained sports inner boots were evaluated by the above-described method. Table 2 shows the evaluation results.

WORKING EXAMPLE 2 TO 5

The proportions of the raw material resins and similar materials were changed as shown in Table 1, and except for those were constituted similar to Working Example 1 to obtain the sports inner boots of Working Examples 2 to 5. The hardness and the wear comfort of the obtained sports inner boots were evaluated by the above-described method. Table 2 shows the evaluation results.

TABLE 1

| | Composition Of Molding Raw Material (Weight %) | | | | | | | | | |
|---|---|---|---|---|---|---|---|---|---|---|
| | Raw Material Resin | | | | | | Additive | | | |
| | Resin A | Resin B | Resin C | Resin D | Resin E | Resin F | Fine Talc Powder | Wear Resistant Agent | Zinc Oxide | Zinc Stearate |
| Working Example 1 | 57 | 0 | 13 | 0 | 6 | 0 | 6 | 3 | 2 | 1 |
| Working Example 2 | 35 | 0 | 0 | 15 | 0 | 27 | 0 | 8 | 2 | 1 |
| Working Example 3 | 28 | 4 | 36 | 0 | 6 | 0 | 10 | 3 | 2 | 1 |
| Working Example 4 | 20 | 6 | 39 | 0 | 13 | 0 | 6 | 3 | 2 | 1 |
| Working Example 5 | 0 | 13 | 49 | 0 | 16 | 0 | 6 | 3 | 2 | 1 |
| Working Example 6 | 0 | 27 | 28 | 0 | 23 | 0 | 6 | 3 | 2 | 1 |

| | Composition Of Molding Raw Material (Weight %) Additive | | | | | |
|---|---|---|---|---|---|---|
| | Stearic Acid | Titanium Dioxide | Crosslinking Agent | Foaming Agent | Accelerator-1 | Accelerator-2 |
| Working Example 1 | 2 | 4 | 1 | 2 | 2 | 1 |
| Working Example 2 | 1 | 6 | 1 | 2 | 1 | 1 |
| Working Example 3 | 1 | 4 | 1 | 2 | 1 | 1 |
| Working Example 4 | 1 | 4 | 1 | 2 | 1 | 1 |
| Working Example 5 | 1 | 4 | 1 | 2 | 1 | 1 |
| Working Example 6 | 1 | 4 | 1 | 2 | 1 | 1 |

TABLE 2

| | Evaluation Results Of Sports Inner Boots | | |
|---|---|---|---|
| | Formability | Hardness | Wear Comfort |
| Working Example 1 | Good | 53 | Fair |
| Working Example 2 | Good | 48 | Fair |
| Working Example 3 | Good | 43 | Good |
| Working Example 4 | Good | 38 | Good |
| Working Example 5 | Good | 33 | Good |
| Working Example 6 | Fair | 28 | Good |

Second Embodiment

Figure 4:
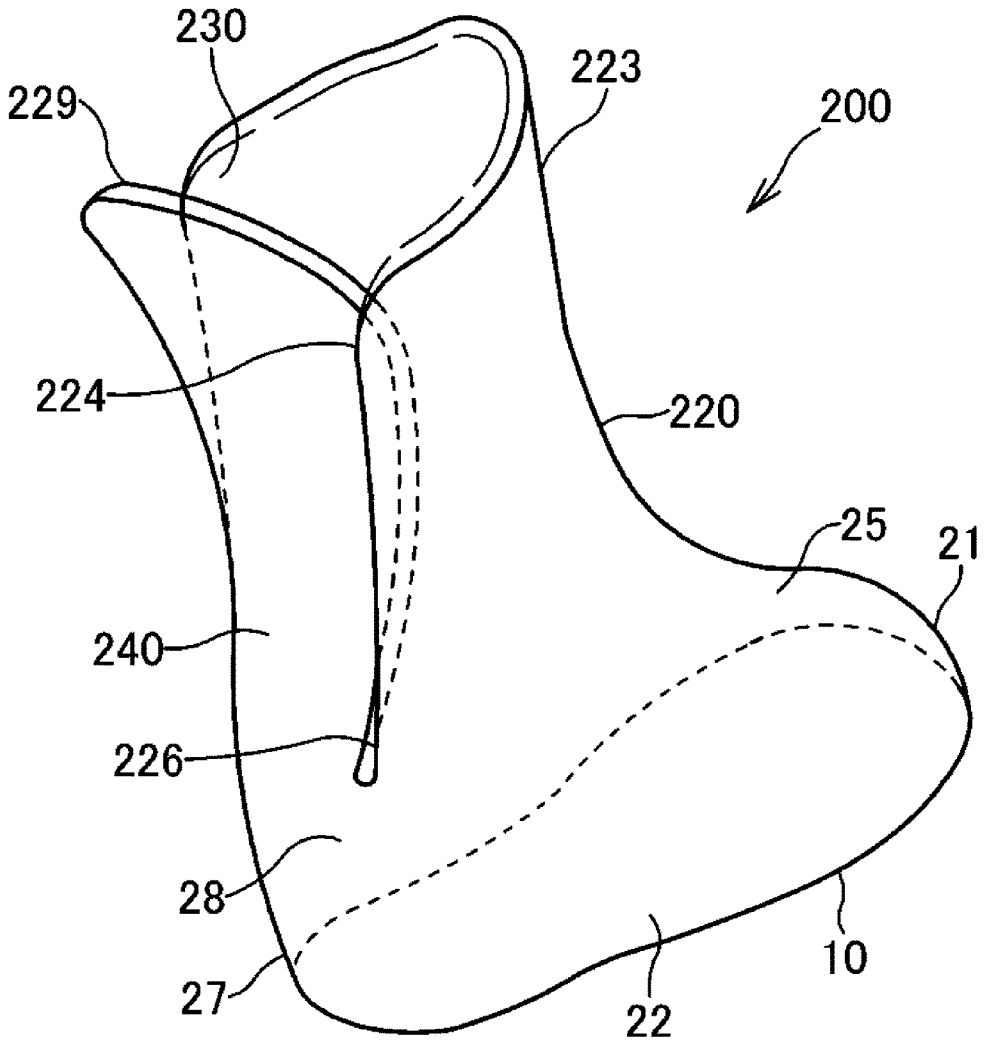
FIG. 4 is a perspective view illustrating sports inner boots of a second embodiment.

FIG. 4 is a perspective view illustrating sports inner boots 200 of the second embodiment. As illustrated in FIG. 4, the sports inner boot 200 of the second embodiment includes a foot wrap portion 220 that has a rear opening 230 and a rear open/close body 240 formed to obstruct the rear opening 230. The parts corresponding to those illustrated in FIG. 1 are denoted by the identical reference numerals as those in FIG. 1.

The foot wrap portion 220 includes a tubular portion 223 with the rear opening 230 to put the foot of the user. The tubular portion 223 forms an upper portion of the foot wrap portion 220 into an approximately tubular shape. A rear portion of the tubular portion 223 forms a cutout 226 from a rim 224 to the heel portion 28 to form the expandable rear opening 230. The rear open/close body 240 is provided to ensure closing this rear opening 230.

The rear open/close body 240 is integrally formed with the heel portion 28 of the foot wrap portion 220 extending to the upper portion. The upper portion of the rear open/close body 240 is formed to further warp an upper end of a calf portion 229 to the rear portion side so as to go along the calf of the user.

The sports inner boot 200 of the second embodiment is opened rearward with a lower portion of the rear open/close body 240 of the sports inner boot 200, which is inserted into the sports outer boot for disposition, as an axis. The rear opening 230 is expanded as necessary to allow the user to put the foot from the tubular portion 223 to the inside of the sports inner boot 200. Thus, the user can easily wear and remove the sports inner boot 200.

After the snowboarding or the skiing, the snowboarder or the skier can take out the sports inner boots 200 from the snowboard or ski outer boots. The removed sports inner boots 200 can be dried and washed. Similar to the sports inner boots 100 of the first embodiment, since the sports inner boots 200 are not soaked with water even washed, the drying time can be the comparatively short time. This allows the sports inner boots 200 to be easily cleaned.

Third Embodiment

Figure 5:
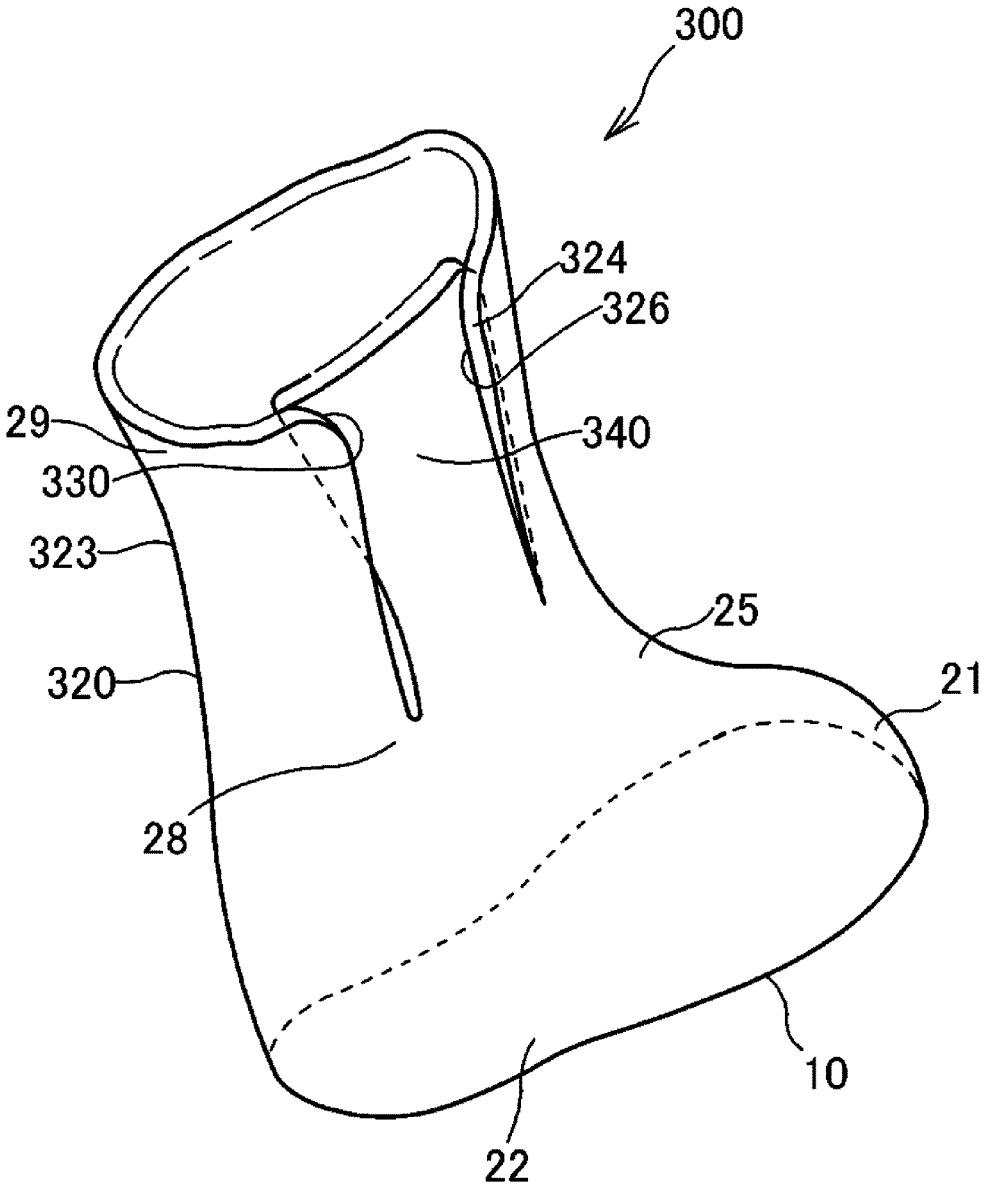
FIG. 5 is a perspective view illustrating sports inner boots of a third embodiment.

FIG. 5 is a perspective view illustrating sports inner boots 300 of the third embodiment. As illustrated in FIG. 5, the sports inner boot 300 of the third embodiment includes a foot wrap portion 320 that has a lateral opening 330 and a lateral open/close body 340 formed to obstruct the lateral opening 330. The parts corresponding to those illustrated in FIG. 1 are denoted by the identical reference numerals as those in FIG. 1.

The foot wrap portion 320 includes a tubular portion 323 with the lateral opening 330 to put the foot of the user. The tubular portion 323 forms an upper portion of the foot wrap portion 320 into an approximately tubular shape. A lateral portion of the tubular portion 323 forms a cutout 326 from a rim 324 to the one malleolus portion 28 to form the expandable lateral opening 330. The lateral open/close body 340 is provided to ensure closing this lateral opening 330.

The lateral open/close body 340 is formed integrally with the malleolus portion 28 of the foot wrap portion 320. The lateral open/close body 340 is disposed inside the lateral opening 330 of the tubular portion 323. For use, the lateral open/close body 340 is opened laterally with a lower portion of the lateral open/close body 340 as an axis, and the lateral opening 330 is expanded as necessary, thus ensuring putting the foot of the user from the tubular portion 323 to the inside of the sports inner boot 300.

The sports inner boot 300 of the third embodiment is opened laterally with the lower portion of the lateral open/close body 340 of the sports inner boot 300, which is inserted into the sports outer boot for disposition, as an axis. The lateral opening 330 is expanded as necessary to allow the user to put the foot from the tubular portion 323 to the inside of the sports inner boot 300. Thus, the user can easily wear and remove the sports inner boot 300.

After the snowboarding or the skiing, the snowboarder or the skier can take out the sports inner boots 300 from the snowboard or ski outer boots. The removed sports inner boots 300 can be dried and washed. Similar to the sports inner boots 100 or 200 of the first or the second embodiment, since the sports inner boots 300 are not soaked with water even washed, the drying time can be the comparatively short time. This allows the sports inner boots 300 to be easily cleaned.

Fourth Embodiment

Figure 6:
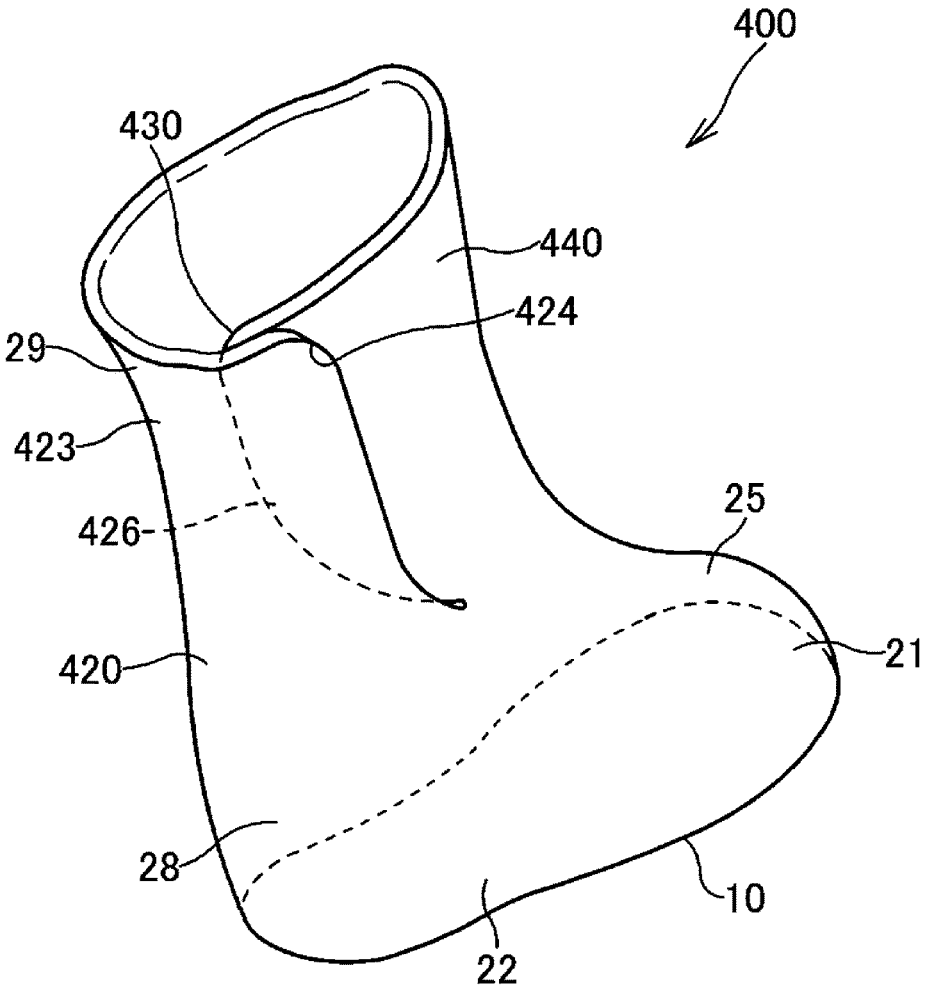
FIG. 6 is a perspective view illustrating sports inner boots of a fourth embodiment.

FIG. 6 is a perspective view illustrating sports inner boots 400 of the fourth embodiment. As illustrated in FIG. 6, the sports inner boot 400 of the fourth embodiment is a so-called roll-up type inner boot. The parts corresponding to those illustrated in FIG. 1 are denoted by the identical reference numerals as those in FIG. 1.

The so-called roll-up type inner boot is configured as follows. In the sports inner boots 100 illustrated in FIG. 1, the one cutout 26 is not formed among both cutouts 26 and 26 to maintain the one side of the front open/close body 40 and the one side of the tubular portion 23 to be joined together. A cutout 426 is formed only on the other side to form a one-side front opening 430. The upper portion of the foot wrap portion 20 including this one-side front opening 430 is designed as a tubular portion 423. The sports inner boot 400 has a roll-up type structure where a front release body 440, which can obstruct the one-side front opening 430, is disposed so as to be rolled up to the inside overlapping with the cutout 426 of the tubular portion 423. The sports inner boot 400 includes a foot wrap portion 420 with this configuration.

That is, the foot wrap portion 420 includes the single cutout 426 from a rim 424 to the instep portion 25 on a front portion of the tubular portion 423 whose upper portion is formed into an approximately tubular shape. This cutout 426 forms the expandable one-side front opening 430. The sports inner boot 400 includes the roll-up type front open/close body 440 that extends inside the front opening 430 to ensure closing this one-side front opening 430 and is disposed so as to be rolled up.

The roll-up type front open/close body 440 is formed integrally with the foot wrap portion 420. The roll-up type one-front open/close body 440 is disposed so as to be rolled up to the inside of the one-side front opening 430 of the tubular portion 423. For use, the one-side front opening 430 is expanded with a lower portion of the front open/close body 440 as an axis, thus ensuring putting the foot of the user from the tubular portion 423 to the inside of the sports inner boot 400.

The sports inner boot 400 of the fourth embodiment is opened forward with a lower portion of the front open/close body 440 of the sports inner boot 400, which is inserted into the sports outer boot for disposition, as an axis. The one-side front opening 430 is expanded as necessary to allow the user to put the foot from the tubular portion 223 to the inside of the sports inner boot 400. Thus, the user can easily wear and remove the sports inner boot 400.

After the snowboarding or the skiing, the snowboarder or the skier can take out the sports inner boots 400 from the snowboard or ski outer boots. The removed sports inner boots 400 can be dried and washed. Similar to the sports inner boots 100, 200, and 300 of the first, the second, or the third embodiment, since the sports inner boots 400 are not soaked with water even washed, the drying time can be the comparatively short time. This allows the sports inner boots 400 to be easily cleaned.

The above-described embodiments describe the sports inner boots applied to the snowboard or ski inner boots. Meanwhile, since the material has the weather resistance, plasticity at low temperature, and flexibility up to −50° C., the embodiments are also similarly applicable to alpine skiing inner boots, skate inner boots, ice hockey inner boots, and other winter sports inner boots, roller skate inner boots, in-line skate inner boots, mountaineering inner boots, bike inner boots, golf inner boots, and other outdoor sports inner boots. The embodiments can also be similarly applicable to inner boots for work shoes. Moreover, the embodiments can also be used for an application of renting these boots.

In the case where the snowboard or ski inner boots 100, 200, 300, and 400 of the above-described embodiments are used for the rental application, since the snowboard or ski inner boots 100, 200, 300, and 400 have the waterproof performance, can be removed from the sports outer boots and the inside can be easily washed, and the drying time can be the comparatively short time. The snowboard or ski inner boots 100, 200, 300, and 400 can be repeatedly used again and again and further can be used hygienically.

DESCRIPTION OF REFERENCE SIGNS

1 snowboard or ski outer boot
10 bottom plate
20, 220, 320, 420 foot wrap portion
21 top surface portion
22 lateral surface portion
23, 223, 323, 423 tubular portion
24, 224, 324, 424 rim
25 instep portion
26, 226, 326, 426 cutout
27 heel portion
28 malleolus portion
29, 229 calf portion
30 front opening
40, 440 front open/close body
100, 200, 300, 400 sports inner boot
230 rear opening
240 rear open/close body
330 lateral opening
340 lateral open/close body
430 one-side front opening

The invention claimed is:

1. An inner boot made of a thermoplastic plastic removably inserted into an outer boot for either skiing or snowboarding, the inner boot comprising:

a bottom plate (10) that is disposed in the outer boot; and a foot wrap portion (20) that is formed at the bottom plate such that the foot wrap has a boot height designed for either skiing or snowboading, the foot wrap potion having a malleolus portion (28) that is to wrap a malleolus of a user, and a calf portion (29) that extends from an upper side of the malleolus portion and so as to go along a calf of the user, wherein:

the inner boot is integrally formed with a single thermoplastic material wherein the thermoplastic material is foamed during only a single foam molding process such that the bottom plate and the foot wrap portion, which has the malleolus portion and the calf portion, are made as a single piece and another member is not disposed on either the malleolus portion or the calf portion of the foot wrap portion, and the thermoplastic material is a mixed resin that comprises a foaming agent and at least two types of ethylene vinyl acetate copolymer resins (or EVAs) that are a first EVA and a second EVA, both of which being comprised of ethylene and vinyl acetate wherein the foaming agent, the first EVA and the second EVA are present in a mixed state, the first EVA is contained in the thermoplastic material within a range from more than 0% to 28% by weight and the second EVA is contained in the thermoplastic material within a range from 4% to 13% by weight, each of the first and second EVAs contains ethylene and vinyl acetate at content percentages by weight and has a predetermined melt flow rate value (or MFR value) and a predetermined hardness, the content percentage of the ethylene in the first EVA is greater than the content percentage of the ethylene in the second EVA, the content percentages of the vinyl acetate in the first and second EVAs are ranged from 25% to 43%, and the content percentage of the vinyl acetate in the first EVA is smaller than the content percentage of the vinyl acetate in the second EVA by around 14% or more, the MFR values of the first and second EVAs are ranged from 7.0 g/10 min to 52.0 g/10 min, and the MFR of the first EVA is smaller than that of the second EVA, a product hardness of the inner boot is ranged from 33° to 43° when measured with an Asker C type durometer, the foaming agent is contained such that the foot wrap expands to reach the boot height through the single foam molding process.

2. The inner boot according to claim 1, the foot wrap portion further comprising:

an expandable front opening (30) that forms an upper portion of the foot wrap portion into an approximately tubular shape, a front portion of the front opening forming a cutout from a rim to an instep portion; and a front open/close body (40) integrally formed with the foot wrap portion to ensure closing the front opening wherein the front open/close body is integrally formed with the foot wrap portion such that the inner boot, which includes the front open/close body, is the single piece.

3. The inner boot according to claim 1, the foot wrap portion further comprising:

an expandable rear opening (230) that forms an upper portion of the foot wrap portion into an approximately tubular shape, a rear portion of the rear opening forming a cutout from a rim to a heel portion; and a rear open/close body (240) integrally formed with the foot wrap portion to ensure closing the rear opening, wherein the rear open/close body is integrally formed with the foot wrap portion such that the inner boot, which includes the rear open/close body, is the single piece.

4. The inner boot according to claim 1, the foot wrap portion further comprising:

an expandable lateral opening (330) that forms an upper portion of the foot wrap portion into an approximately tubular shape, a lateral portion of the lateral opening forming a cutout from a rim to one malleolus portion; and a lateral open/close body (340) integrally formed with the foot wrap portion to ensure closing the lateral opening, wherein the lateral open/close body is integrally formed with the foot wrap portion such that the inner boot which includes the lateral open/close body, is the single piece.

5. The inner boot according to claim 1, wherein the first EVA does not contain any component other than the vinyl acetate and the ethylene, and a difference of the content percentages of the ethylene between the first EVA and the second EVA is at least 14% by weight.

6. The inner boot according to claim 1, wherein the second EVA does not contain any component other than the vinyl acetate and the ethylene, and a difference of the content percentages of the ethylene between the first EVA and the second EVA is at least 14% by weight.

7. The inner boot according to claim 5, wherein the second EVA does not contain any component other than the vinyl acetate and the ethylene.

8. The inner boot according to claim 1, wherein the foaming agent is contained at 2% by weight related to the thermoplastic material.

9. The inner boot according to claim 7, wherein the thermoplastic material further comprises polyolefin of which a percentage related to the thermoplastic material is ranged from 36% to 49% by weight, thermoplastic resin elastomer of which a percentage related to the thermoplastic material is ranged from 6% to 16% by weight, and the polyolefin and the thermoplastic resin elastomer are in a mixed state with the foaming agent and the first and second EVAs in the inner boot.

* * * * *